United States Patent [19]

Cole

[11] 4,293,601

[45] Oct. 6, 1981

[54] FLOWER-LIKE DECORATIVE ORNAMENT

[76] Inventor: Bernard M. Cole, 7 Park Dr. East, Old Westbury, N.Y. 11568

[21] Appl. No.: 184,417

[22] Filed: Sep. 5, 1980

[51] Int. Cl.[3] ..... A41G 1/00

[52] U.S. Cl. ..... 428/24; 24/18; 229/46

[58] Field of Search ..... 24/18; 206/457, 458, 206/805; 428/24, 25, 26; 229/46

[56] References Cited

U.S. PATENT DOCUMENTS

| | | | |
|---|---|---|---|
| 363,058 | 5/1887 | Friedlaender | 428/24 |
| 1,148,208 | 7/1915 | Allison | 428/24 X |
| 2,471,949 | 5/1949 | Gilowitz | 428/24 X |
| 3,370,779 | 2/1968 | Cole | 428/4 X |
| 3,832,841 | 9/1974 | Cole | 428/230 X |
| 4,201,806 | 5/1980 | Cole | 24/18 X |

*Primary Examiner*—Henry F. Epstein
*Attorney, Agent, or Firm*—James & Franklin

[57] ABSTRACT

A flower-like decorative ornament for use in gift-wrapping a package comprises an artificial flower and an elasticized cord, with the free ends of the cord extending upwardly through the flower to provide the appearance of stamens.

8 Claims, 3 Drawing Figures

FLOWER-LIKE DECORATIVE ORNAMENT

BACKGROUND OF THE INVENTION

The present invention relates to decorative ornaments for use in gift-wrapping a package, and more particularly to such an ornament having a realistic flower-like appearance.

Decorative ornaments for use in gift-wrapping packages are well known in the art. Such an ornament should be simple and inexpensive to manufacture (to maintain a low purchase cost for the ornament), easily and rapidly applied to the package (to minimize the cost of performing the gift-wrapping), and securely attachable to the package (so that the gift recipient has an opportunity to view the ornament on the package, and not detached therefrom). But over and above such economic and functional considerations, an ornament which is designed to create a flower-like appearance should provide the detailed, realistic and aesthetic appearance of a flower. Because the artificial flowers must be provided at relatively low cost, generally the mass produced artificial flowers of the prior art have consisted simply of the petals comprising the bud, or such petals along with a stem and sometimes a bit of leaf. Thus the flowers have lacked any semblance of stamens despite the increase in detail, realism and aesthetic value which would result from the provision of such stamens.

Accordingly, it is an object of the present invention to provide a detailed, realistic and aesthetic flower-like decorative ornament for use in gift-wrapping a package.

A further object is to provide such an ornament which provides the appearance of stamens within the flower.

Another object is to provide such an ornament which is simple and inexpensive to manufacture, easily and rapidly applied to the package, and securely attachable thereto.

SUMMARY OF THE INVENTION

It has now been found that the above and related objects of the present invention are obtained in a flower-like decorative ornament for use in gift-wrapping a package comprising an artificial flower and an elasticized cord. The artificial flower comprises a base, a pattern of petals extending at least partially upwardly from the base, and a passage extending longitudinally through the base. The elasticized cord has its end portions knotted together to define a section of enlarged diameter incapable of passing through the passage, a pair of free ends to one side of the enlarged section, and a loop to the other side thereof. The loop passes longitudinally through the passage with the enlarged section being at least partially disposed above the passage to slidably mount the flower on the loop. The cord is configured and dimensioned such that when the loop is stretched about a package so that the enlarged section is disposed immediately atop the passage, the free ends extend at least partially upwardly from the enlarged section and terminate closely adjacent the uppermost portions of the petals, whereby the free ends provide the appearance of stamens.

In a preferred embodiment the passage extends longitudinally through the center of the base, and the pattern of petals comprises at least one generally circumferential pattern of closely spaced petals. The enlarged section is preferably spaced inwardly from the petal pattern, thereby to facilitate sliding movement of the flower along the loop. The tops of the free ends are preferably visible from the top of the flower, the free ends for that function typically extending at least 1.5 cms. beyond the enlarged section.

Generally it is preferred that the petals extend generally upwardly from the base a substantial length to define a partially open bud and that the free ends extend generally upwardly a substantial length and terminate closely adjacent the uppermost portions of the petals for ready visibility.

DETAILED DESCRIPTION OF THE PREFERRED EMBODIMENTS

Figure 1:
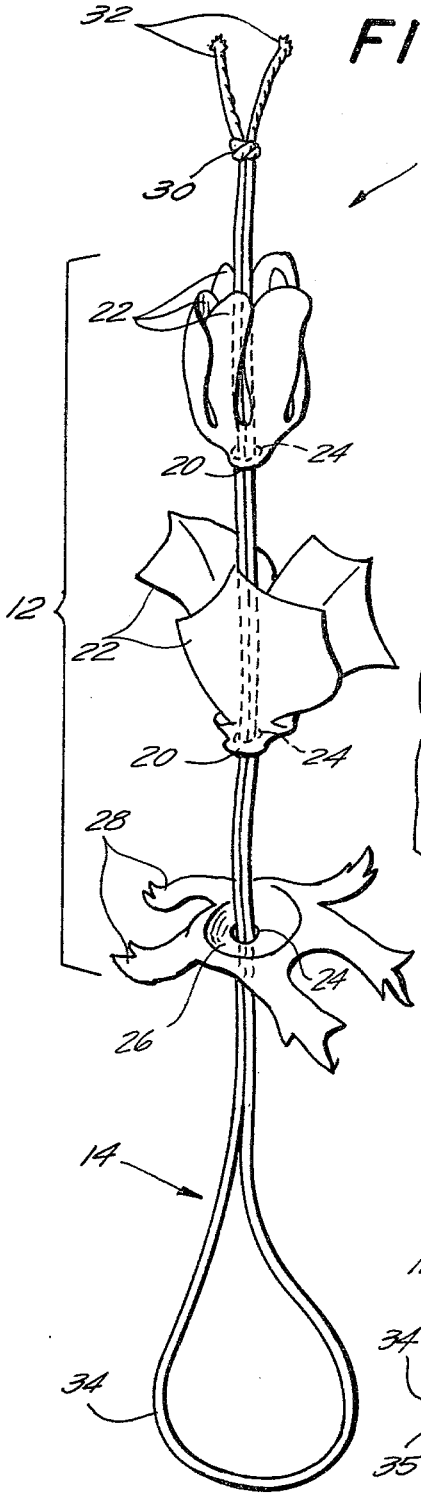
FIG. 1 is an isometric view of the ornament with the parts thereof shown in spaced juxtaposition.

Referring now to the drawing, and in particular to FIG. 1 thereof, the flower-like decorative ornament 10 of the present invention, suitable for use in gift-wrapping a package, comprises an artificial flower generally designated 12 and an elasticized cord generally designated 14. The artificial flower 12 in turn comprises at least one base 20 from which a pattern of petals 22 extends at least partially upwardly. A passage 24 extends longitudinally through the base 20 to enable attachment of the flower 12 to the cord 14 as hereinafter described. The petals 22 may be formed separately from the base 20 and secured thereto by conventional means or, as illustrated, the petals 22 and the base 20 may be integral. Preferably the pattern of petals 22 comprises at least one generally circumferential pattern of closely spaced petals, with the passage 24 extending longitudinally through the center of the base 20. Depending upon the type of flower being represented --here a rose-- there may be one or more bases 20, each having its own pattern of petals 22 extending at least partially upwardly therefrom. Preferably the petals 22 extend generally upwardly from the base 20 a substantial length, the exact orientation of the petals 22 and the length thereof being, of course, dependent upon the type of flower being represented.

The flower 12 may be formed of any material conventionally used in the formation of artificial flowers. While plastic is a preferred material in view of its cheapness and easy moldability, other materials may be substituted therefor. If a more fragile material is used, it may be desirable to reinforce the base 20 in the area of the passage 24 so as to fix a maximum width or diameter for the passage 24.

While the petals 22 extend generally upwardly a substantial length to define a partially open bud, it may also be desirable to provide a secondary base 26 having a pattern of green leaves 28 extending at least partially horizontally or even downwardly from the secondary base 26.

The elasticized cord 14 for use with the above-described flower 12 has its end portions knotted together to define a section 30 of enlarged diameter (that is, the knot) incapable of passing through the passage 24, a pair of free ends 32 disposed to one side of the enlarged section 30, and a loop 34 disposed on the other side of the enlarged section 30. The loop 34 passes longitudinally through the passage 24 in the base 20 with the enlarged section 30 being partially exposed above the passage 24 to slidably mount the flower 12 on the loop 34. To facilitate sliding movement on the flower 12 along the loop 34, the enlarged section 30 is preferably spaced inwardly from the innermost petal pattern, thus avoiding friction between the petals 22 and the enlarged section 30.

Figure 2:
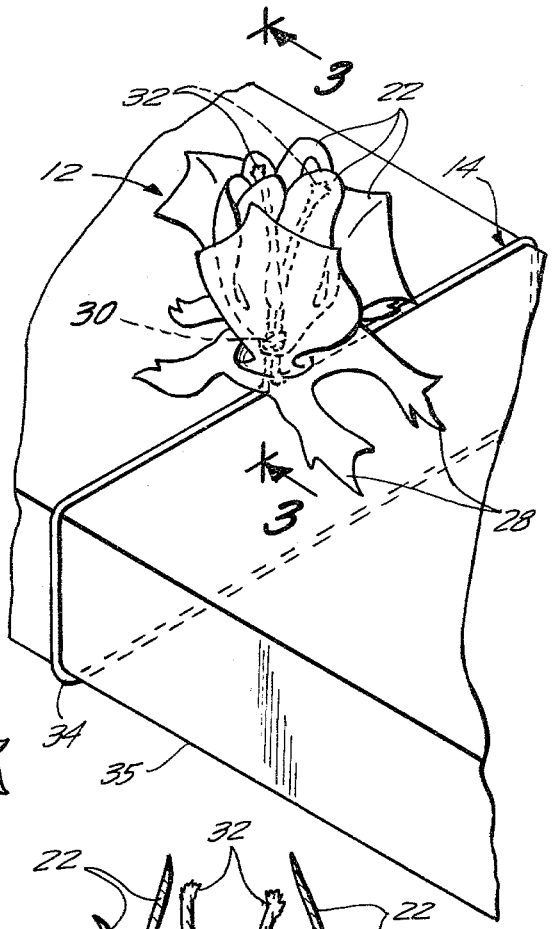
FIG. 2 is a fragmentary isometric view of the ornament in use on a box.
Figure 3:
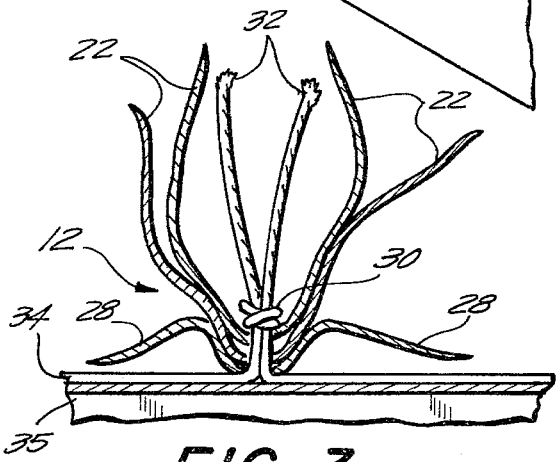
FIG. 3 is an elevational section along the line 3—3 of FIG. 2.

Referring now in particular to FIGS. 2 and 3, the cord 14 is configured and dimensioned such that when the loop 34 is stretched about a package 35 so that the enlarged section 30 is disposed immediately atop the passage 24, the free ends 32 extend at least partially upwardly from the enlarged section 30 and terminate closely adjacent the uppermost portions of the petals 22. Preferably the free ends 32 extend generally upwardly a substantial length (typically at least 1.5 cms.) and terminate closely adjacent the uppermost portions of the petals 22 for ready visibility. The tops of the free ends 32 are visible from the top of the flower 12, and, depending upon the closeness of the lateral spacing of the petals 22, the free ends 32 may also be visible from a side of the flower 12. The exposed free ends 32 give the appearance of stamens and thus provide a detailed and realistic aspect to the ornament as well as enhancing its overall aesthetic nature. A commonly available silver colored elasticized cord 14 is preferred because the free ends shimmer and give the appearance of moist stamens.

The ornament 10 is easily constructed by simply pushing the loop 34 downwardly through the passage 24 of the flower 12 or, alternatively, threading the end portions (before knotting) of the cord 14 upwardly through the passage 24 and then knotting them together. The assembled ornament is then ready for use or storage and later use. The ornament is then used by simply stretching the cord loop 14 and slipping it over a package 35 of suitable size, thereby easily and rapidly applying the ornament 10 to the package 35 and securely attaching it thereto.

Note that the flower itself may be any artificial flower 12 having the requisite base 20, petal pattern and passage 24. Indeed, an artificial flower having the requisite base and petal pattern without the requisite passage may also be utilized simply by modifying the flower to provide a suitable passage; for example, by cutting an appropriate passage through the base (and any secondary base). It will be appreciated that the cord 14 may function not only to secure the flower 12 to the package, but also to hold various portions of the flower 12 in appropriate juxtaposition. For example, in the specific flower illustrated, as shown clearly in FIG. 1, there are two circumferential patterns of petals 22 and one circumferential pattern of leaves 28, each pattern being on its own base 20 or secondary base 26. When the cord 14 is stretched about a package 35, as shown in FIGS. 2 and 3, the tension on the cord 14 pushes the secondary base 26 upwardly while the enlarged cord section 30 precludes upward movement of the innermost pattern of petals 22 secured to the upper base 20. Preferably the passage 24 extending through the secondary base 26 is dimensioned so that there is sufficient friction between the secondary base 26 and the cord loop 34 during storage before use to preclude the secondary base 26 from sliding off the loop 34 under the weight of the flower alone.

To summarize, the present invention provides a flower-like decorative ornament which is in appearance detailed, realistic and aesthetic. Furthermore, the ornament is simple and inexpensive to manufacture, easily and rapidly applied to the package and securably attachable thereto.

Now that the preferred embodiments of the present invention have been shown and described in detail, various modifications and inprovements thereon will become readily apparent to those skilled in the art. Accordingly, the spirit and scope of the present invention is to be limited only by the appended claims, and not by the foregoing disclosure.

I claim:

1. A flower-like decorative ornament for use in gift-wrapping a package comprising:

(A) an artificial flower comprising a base, a pattern of petals extending at least partially upwardly from said base, and a passage extending longitudinally through said base; and (B) an elasticized cord having its end portions knotted together to define a section of enlarged diameter incapable of passing through said passage, a pair of free ends to one side of said enlarged section and a loop to the other side thereof; said loop passing longitudinally through said passage with said enlarged section being at least partially disposed above said passage to slidably mount said flower on said loop, said cord being configured and dimensioned such that when said loop is stretched about a package so that said enlarged section is disposed immediately atop said passage, said free ends extend at least partially upwardly from said enlarged section and terminate closely adjacent the uppermost portions of said petals, whereby said free ends have the appearance of stamens.

2. The ornament of claim 1 wherein said passage extends longitudinally through the center of said base, and said pattern of petals comprises at least one generally circumferential pattern of closely spaced petals.

3. The ornament of claims 1 or 2 wherein said enlarged section is spaced inwardly from said petal pattern, thereby to facilitate sliding movement of said flower along said loop.

4. The ornament of claim 1 wherein the tops of said free ends are visible from the top of said flower.

5. The ornament of claim 1 wherein said free ends extend at least 1.5 cm. beyond said enlarged section.

6. The ornament of claim 1 wherein said petals extend generally upwardly from said base a substantial length to define a partially open bud.

7. The ornament of claims 1 or 6 wherein said free ends extend generally upwardly from said enlarged section for a substantial length and terminate closely adjacent said uppermost portions of said petals for ready visibility of said free ends.

8. The ornament of claim 1 wherein said cord secures said pattern of petals to said base when said loop is stretched about a package.

* * * * *